US010036195B2

(12) United States Patent
Iglesias Ballester

(10) Patent No.: US 10,036,195 B2
(45) Date of Patent: Jul. 31, 2018

(54) MODULAR ENCLOSURE

(71) Applicant: AMISERRU, S.L., Barcelona (ES)

(72) Inventor: Miguel Angel Iglesias Ballester, Barcelona (ES)

(73) Assignee: AMISERRU, S.L., Barcelona (ES)

( * ) Notice: Subject to any disclaimer, the term of this patent is extended or adjusted under 35 U.S.C. 154(b) by 1 day.

(21) Appl. No.: 15/506,292

(22) PCT Filed: Jul. 13, 2015

(86) PCT No.: PCT/ES2015/070547

§ 371 (c)(1),
(2) Date: Feb. 24, 2017

(87) PCT Pub. No.: WO2016/030556

PCT Pub. Date: Mar. 3, 2016

(65) Prior Publication Data

US 2017/0254141 A1 Sep. 7, 2017

(30) Foreign Application Priority Data

Aug. 29, 2014 (ES) ..... 201431267

(51) Int. Cl.

| | |
|---|---|
| ***E05F 15/00*** | (2015.01) |
| ***E06B 5/00*** | (2006.01) |
| ***E06B 1/52*** | (2006.01) |
| ***E06B 1/60*** | (2006.01) |
| ***E06B 9/68*** | (2006.01) |

(Continued)

(52) U.S. Cl.

CPC ..... *E06B 5/00* (2013.01); *E05F 15/43* (2015.01); *E05F 15/668* (2015.01); *E05F 15/74* (2015.01); *E06B 1/52* (2013.01); *E06B 1/6038* (2013.01); *E06B 7/23* (2013.01); *E06B 9/68* (2013.01); *E06B 9/70* (2013.01); *E05F 2015/765* (2015.01); *E06B 2009/587* (2013.01); *E06B 2009/588* (2013.01); *E06B 2009/6827* (2013.01)

(58) Field of Classification Search

CPC . E06B 5/00; E06B 1/52; E06B 1/6038; E06B 7/23; E06B 9/68; E06B 9/70; E06B 9/58; E06B 9/581; E06B 2009/585; E06B 2009/587; E06B 2009/588; E06B 9/17; E06B 9/17007; E06B 9/1703; E06B 9/17015; E06B 9/17023; E06B 9/42; E05F 15/43; E05F 15/668; E05F 15/74

See application file for complete search history.

(56) References Cited

U.S. PATENT DOCUMENTS

| | | | | |
|---|---|---|---|---|
| 9,347,258 | B2 * | 5/2016 | Dwarka | E06B 9/24 |
| 2003/0089461 | A1 * | 5/2003 | Dondlinger | B23K 9/32 |

(Continued)

FOREIGN PATENT DOCUMENTS

| | | | | |
|---|---|---|---|---|
| GB | 2348217 | * | 9/2000 | E04B 1/14 |

*Primary Examiner* — Brian D Mattei

(74) *Attorney, Agent, or Firm* — Hodgson Russ LLP

(57) ABSTRACT

The enclosure comprises: a partition (1) of panels (2) provided with longitudinal grooves (3) and a space for mounting a door (6); and a door (6) comprising: an upper box (7); and two vertical posts (9) with vertical guides (30) for moving a closing element (10), in addition to longitudinal channels (15) defining passages, with the longitudinal grooves (3), for housing fastening elements (16, 17) that can be vertically moved between a position wherein the door (6) is held and a position wherein the door (6) is released. The door comprises means for ensuring peripheral tightness in the closed position.

16 Claims, 7 Drawing Sheets

(51) Int. Cl.

| | |
|---|---|
| ***E06B 9/70*** | (2006.01) |
| ***E06B 7/23*** | (2006.01) |
| ***E05F 15/668*** | (2015.01) |
| ***E05F 15/74*** | (2015.01) |
| ***E05F 15/43*** | (2015.01) |
| *E06B 9/58* | (2006.01) |
| *E05F 15/73* | (2015.01) |

(56) References Cited

U.S. PATENT DOCUMENTS

| | | | | |
|---|---|---|---|---|
| 2003/0188837 | A1* | 10/2003 | Varley et al. | E06B 9/13 |
| 2005/0224700 | A1* | 10/2005 | Petra | E06B 9/58 |
| 2011/0108214 | A1* | 5/2011 | Komatsu et al. | E06B 9/13 |
| 2013/0228289 | A1* | 9/2013 | Klish et al. | E06B 9/82 |
| 2016/0053536 | A1* | 2/2016 | Craney | E06B 9/58 |
| 2016/0102489 | A1* | 4/2016 | Iglesias Ballester | E05F 15/72 |
| 2017/0058513 | A1* | 3/2017 | Siller | E04B 1/947 |
| 2017/0328126 | A1* | 11/2017 | Bonge, Jr. | E06B 7/32 |
| 2018/0038160 | A1* | 2/2018 | James et al. | E06B 9/00 |

* cited by examiner

MODULAR ENCLOSURE

OBJECT OF THE INVENTION

The invention relates to a modular enclosure which comprises: a partition made up of panels provided on the ends thereof with longitudinal grooves for mounting coupling elements, said partition defining at least a space for mounting a door; and a door that couples to the space of the partition and which comprises: an upper box; two vertical posts which delimit a passage space and which have vertical guides for moving a closing tarpaulin which is fixed by the upper end thereof to a winding drum coupled to drive means of actuation.

FIELD OF APPLICATION OF THE INVENTION

This modular enclosure is applicable to the field of construction and preferably to interior separations for laboratories or pressurized spaces.

STATE OF THE ART

In the field of construction, there are commonly used modular enclosures made up basically of panels which may have different make-ups based on the specific requirements for each installation.

These panels are generally mounted on support profiles, and known in the state of the art, for example, is the use of panels that have grooves on the vertical ends thereof for coupling to vertical profiles which have two longitudinal attachments on opposite faces suitable to be housed in the grooves of two consecutive panels, acting as a joining and aligning element for the same.

Also common for this type of enclosure is the provision on the floor and on the upper part of the partition of U-shaped guides for the introduction of the upper and lower ends of the panels.

In this type of enclosure, the doors are usually arranged so that they are adjoining to one of the faces of the panels, flush with the same, with the vertical posts of said door delimiting the passage space.

The technical problem with this type of mounting is that, in the case of a rupture or deterioration of one of the intermediate panels, in order to substitute it, it is necessary to disassemble the entire line of panels from one of the ends of the partition to reach the damaged panel.

Another drawback of these enclosures is that the quick-opening doors do not provide a closure with a proper tightness to be applied in certain facilities, for example laboratories.

Another technical problem with these enclosures is the integration of the door in the partition, especially when said door is a quick-opening door in which the closing tarpaulin is associated on the upper end thereof with a motorized winding drum, since on these types of doors the actuating motor of the drum is arranged on the outer part of the frame, laterally protruding from the same.

DESCRIPTION OF THE INVENTION

The modular enclosure, object of this invention, being of the type described in the pre-characterized part of the first claim, has some particular constructive characteristics designed to solve the aforementioned technical problems; presenting therefore particular constructive characteristics that allow for the mounting and disassembly of the door in a quick and easy way, in a frontal direction and without the need to disassemble the adjacent panels of the partition.

Another objective of the invention is to facilitate the integration of the door in the partition, said door being a quick-opening door; and achieving a tight closure of the door, considering the type of application the enclosure will have.

Another objective of the invention is to achieve a peripheral tightness of the closing tarpaulin when the door is closed, especially when one of the enclosures delimited by the door is pressurized, which is common in the case of laboratories.

Another objective of the invention is to provide the door with proper means to run cables to the inside of the frame and access to the different elements during the operations of mounting or repairing the door.

According to the invention, the vertical posts of the frame comprise longitudinal channels facing the longitudinal grooves of the panels which delimit the mounting space of the door; said longitudinal grooves defining passages for housing fastening elements which can be vertically moved between a position wherein the door is held with respect to the partition, and a position wherein the door is released.

This characteristic allows the door to be frontally removed from the space of the partition, simply by moving the fastening elements towards the position of disassembly without the need to disassemble or move the panels of the partition.

Another characteristic of the invention which simplifies the operations of mounting and repairing the door, is that the upper box of the winding drum and the drive means make up an independent unit, fixed in a detachable way to the vertical posts of the door.

In accordance with the invention, the aforementioned drum is coupled by transmission means of a rotational movement, to a motor element arranged on a plane below the drum and in the space comprised between the vertical posts of the frame.

This way the motor element and the electric panel for controlling the same do not protrude laterally from the door, which facilitates the integration of the door in the space for mounting the partition.

With the aim of achieving peripheral tightness in the closed position, the upper box comprises on the lower part thereof a groove for the passage of the closing tarpaulin and, on opposite sides of said groove, sealing gaskets that act on said closing tarpaulin. Likewise, said tarpaulin has a transversal bulge on an upper area thereof which, in the closed position of the door, acts on said sealing gaskets, guaranteeing tightness in the upper closure.

To guarantee tightness in the area of contact with the floor, the closing tarpaulin has on the lower end thereof a first weight for vertical tension, in any open position, complete or partial, of the door; and below said first weight, a second weight for the adjustment to the floor.

To guarantee lateral tightness, the closing tarpaulin comprises on the lateral edges thereof vertical rows with stops which are moveable through the inside of a guide mounted on an intermediate notch of the corresponding vertical post of the door. The closing tarpaulin is sized such that:—when it is not subjected to any frontal pressure or thrust, the stops are loosely arranged inside the vertical guides, able to move through the inside without significant friction against the guides, and—when the door is closed and the tarpaulin is subjected to a frontal pressure or thrust, said stops act against the inner surface of the guides, and the tarpaulin becomes curved by the effect of the pressure, establishing a tight lateral closure against the aforementioned vertical guides.

The characteristics of the invention, set out in the attached claims, are more easily understood by viewing the example shown in the attached figures.

DESCRIPTION OF THE FIGURES

As a complement to the description being made, and for the purpose of helping to make the characteristics of the invention more readily understandable, this specification is accompanied by a set of drawings which, by way of illustration and not limitation, represent the following.

FIG. 7 shows a perspective view of an exploded detail of one of the upper ends of the door, in which it is possible to see one of the covers and one of the fastening brackets of the upper box, said bracket having a groove for cables to pass through.

PREFERRED EMBODIMENT OF THE INVENTION

Figure 1:
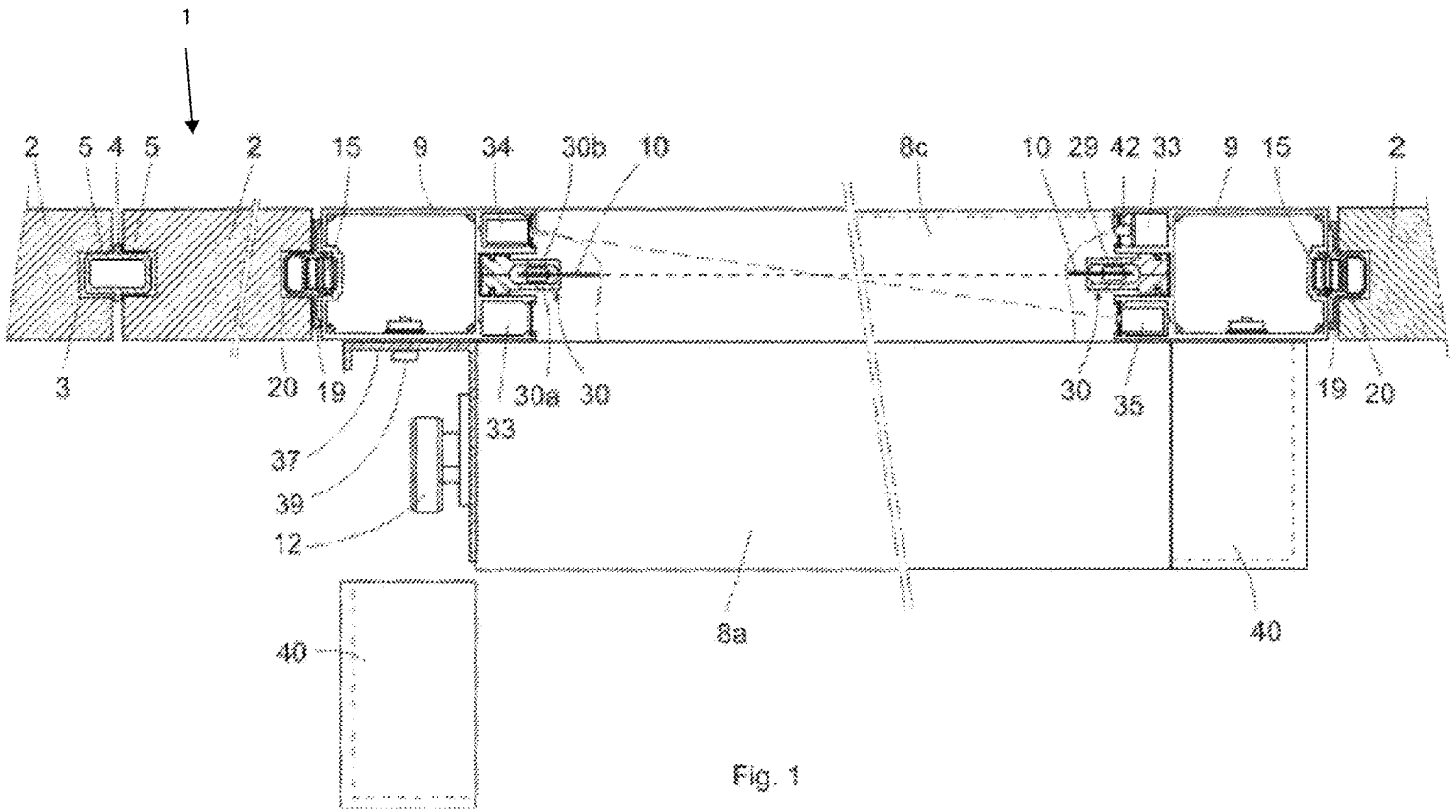
FIG. 1 shows an upper plan view of a preferred embodiment of the modular closure according to the invention in cross section by a horizontal plane and in which a door for passage is integrated, the upper box of which is represented in partial cross section and with one of the side covers removed.

As can be seen in the example shown in FIG. 1, this modular enclosure comprises a partition (1) made up of panels (2H) provided with longitudinal grooves (3) on the ends thereof for the mounting of first profiles (4) which have attachments (5) on opposite faces to couple to the longitudinal grooves (3) of the consecutive panels (2).

This enclosure comprises a door (6) which is insertable in a space of the partition (1) which comprises an upper box (7) and two vertical posts (9) which delimit a passage space and which have vertical guides (30) for the movement of a closing tarpaulin (10).

Figure 2:
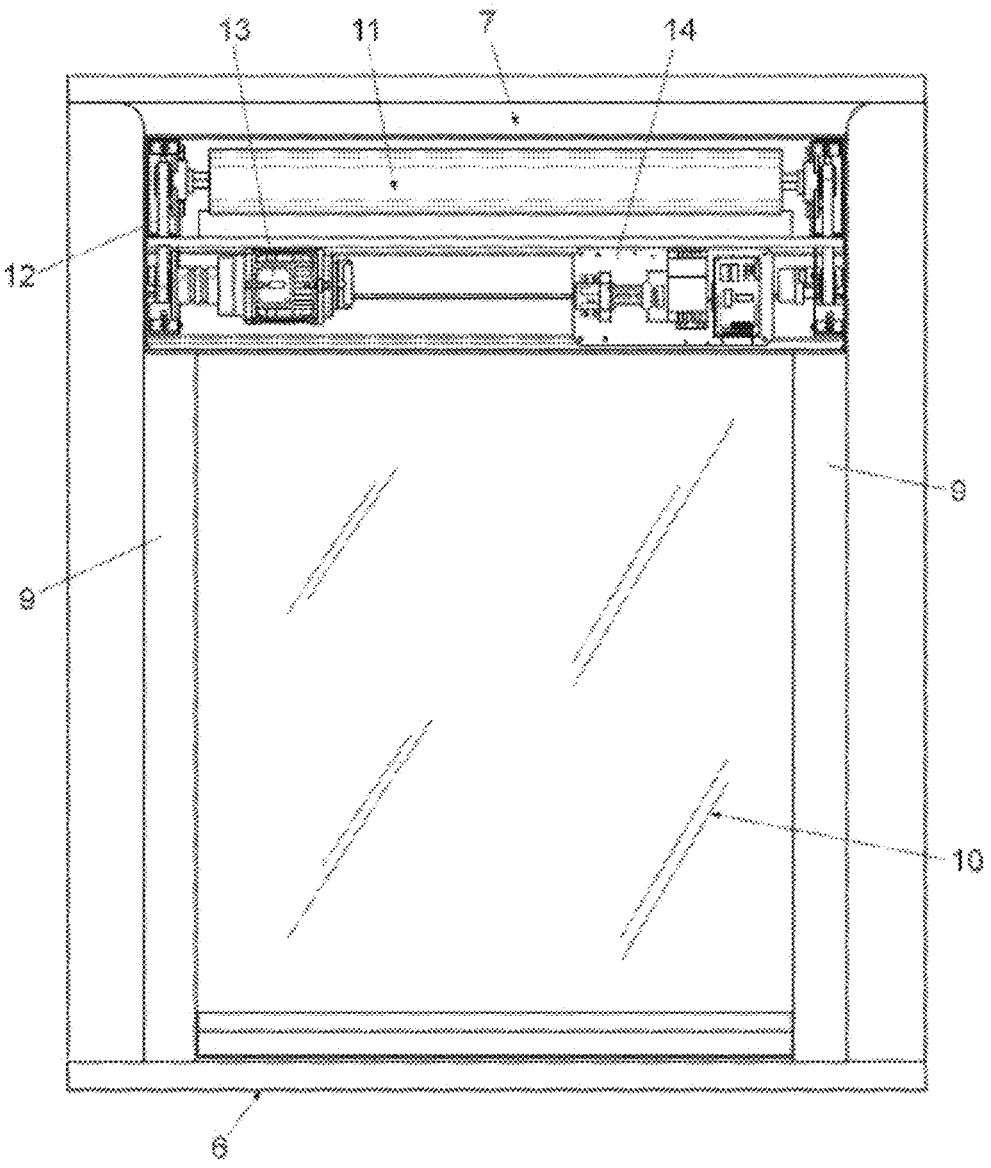
FIG. 2 shows a front elevation view of a preferred embodiment of the door, in this case made up of a motorized fast-opening door.

In FIG. 2, the closing element (10) is made up of a flexible tarpaulin and is fixed by the upper end thereof to a winding drum (11) which is coupled by means of transmission means (12) to a motor (13) arranged on a plane below the mentioned drum (11) and in the space comprised between the vertical posts (9) of the door, such that said motor does not laterally protrude from said vertical posts (9).

Figure 3:
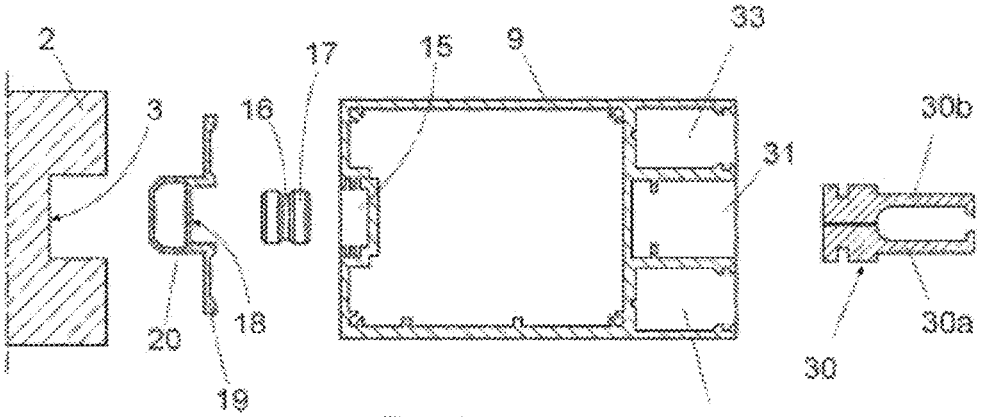
FIG. 3 shows an upper exploded plan view of one of the vertical posts of the door, in which it is possible to see one of the fastening elements of the same with an adjacent panel by means of a second intermediate profile.
Figure 4:
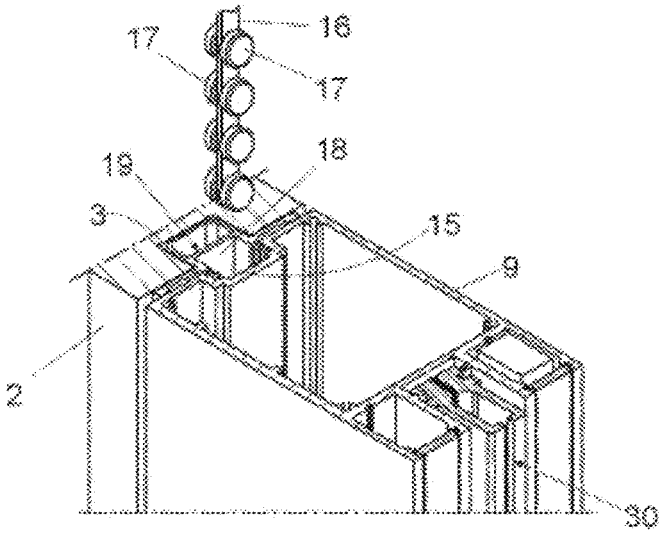
FIG. 4 shows a perspective view of the elements of the preceding figure previously coupled to the mounting of the fastening element of the door of the partition.

In FIGS. 3 and 4, each one of the vertical posts (9) of the frame comprises a longitudinal channel (15) facing the longitudinal groove (3) of a panel (2) adjacent to the partition (1); the enclosure comprising fastening elements from the door to the partition, making it possible for vertical movement between a mounting position and a disassembly position.

Said fastening elements are made up of a flexible strip (16), provided on opposite sides with attachments (17) which are housed in the longitudinal channel (15) of the corresponding vertical post (9) of the door and in a longitudinal groove (18) of a second intermediate profile (19) coupled to said adjacent panel (2).

The aforementioned second intermediate profile (19), on the opposite face of the carrier of the longitudinal groove (18), has a longitudinal attachment (20) which couples to the longitudinal groove (3) of an adjacent panel (2).

The aforementioned fastening elements can be vertically inserted and removed through the upper part of the door, establishing through mounting and disassembly positions the retention and release of the door (6) with respect to the partition (1).

Figure 6:
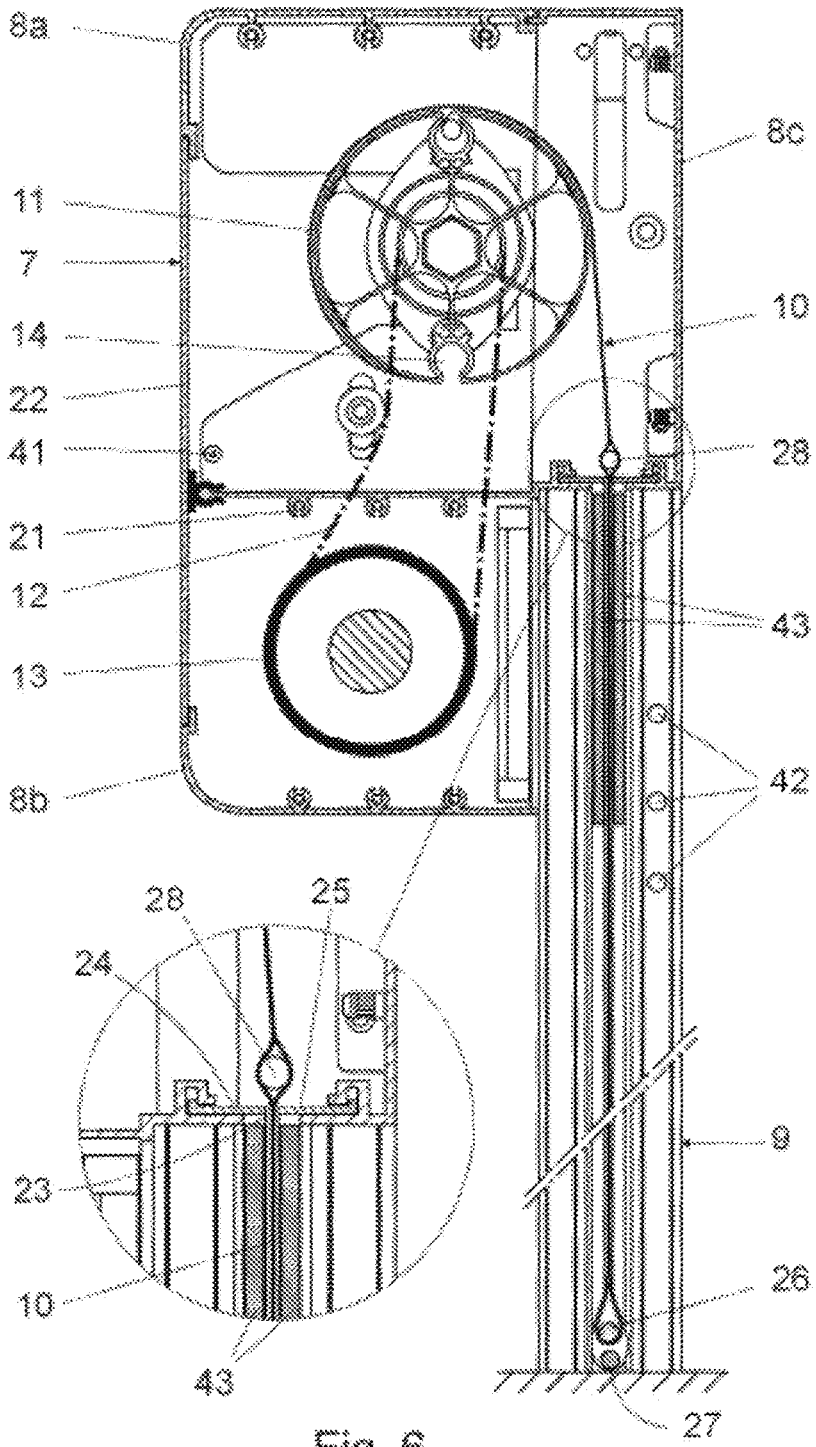
FIG. 6 shows a profile view of an upper portion of the door in cross section by a vertical plane and a detailed enlargement of the closing tarpaulin of the same.
Figure 7:
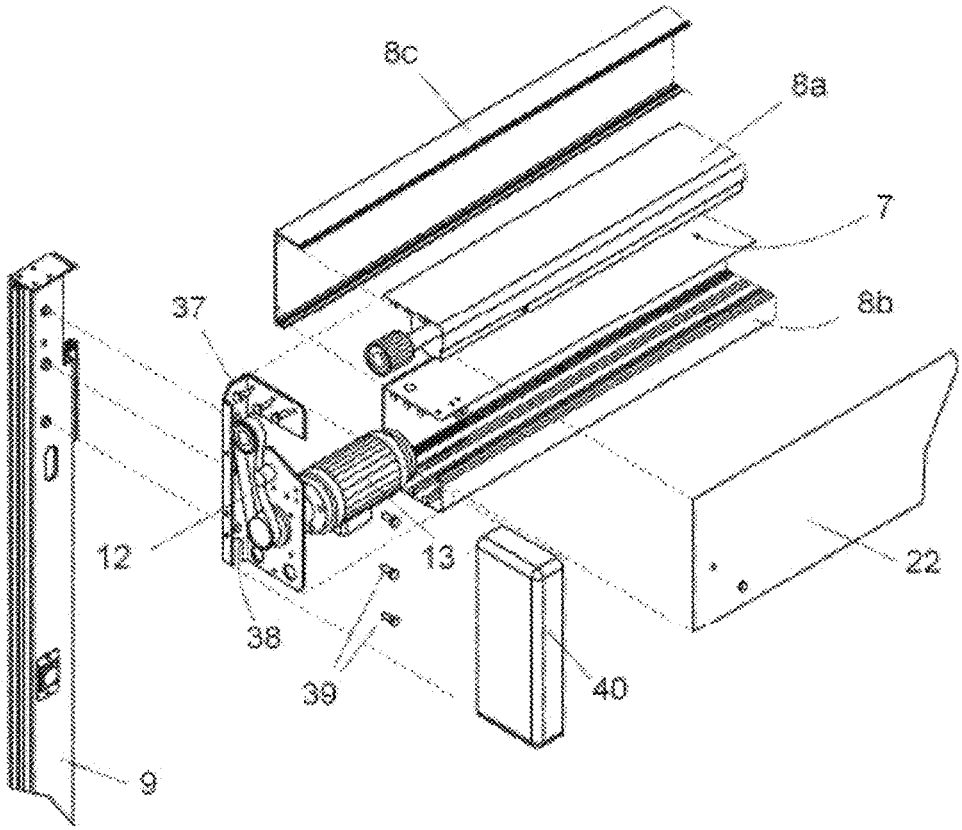

As can be seen in FIGS. 6 and 7, the upper box (7) is made up of horizontal profiles (8*a* and 8*b*), an removable frontal cover (22) and a front cover (8*c*), which is also removable, all of which is joined by means of fastening brackets (37), wherein a winding drum (11) of the closing element (10) and an actuating motor (13) are anchored.

As can be seen in FIG. 6, the horizontal profiles (8*a* and 8*b*) of the door have rails (21) inside which allow for the anchoring of the bracket (37) for formation of the upper box (7).

The front cover (8*c*), along with the horizontal profile (8*b*) of the upper box, (7) defines a groove (23) for the passage of the closing element (10).

The aforementioned front cover (8*c*), as well as the horizontal profile (8*b*) of the upper box (7), has sealing gaskets (24, 25) on opposite sides of the aforementioned groove (23), which act on opposite sides of the closing element (10), as can be seen in FIG. 6, guaranteeing a tight closure of the door in the upper area of the frame.

In the example shown, the element (10) is vertically movable between an opening position and a closing position of the passage space of the door and, as shown in FIG. 6, has on the lower end thereof a first weight (26), vertically tensed, and below it a second weight (27) for the adjustment to the floor; said second weight fixed by means of a loop of tarpaulin thermally bonded to said closing tarpaulin (10).

The closing tarpaulin (10) has a transversal bulge (28) on an upper area thereof, which in the closed position shown in FIG. 6 acts on said sealing gaskets (24, 25), ensuring an tight upper closure.

To prevent the transversal bulge (28) from impeding a correct winding of the tarpaulin (10), the drum (11) has a transverse groove (14) for the housing thereof.

Figure 5:
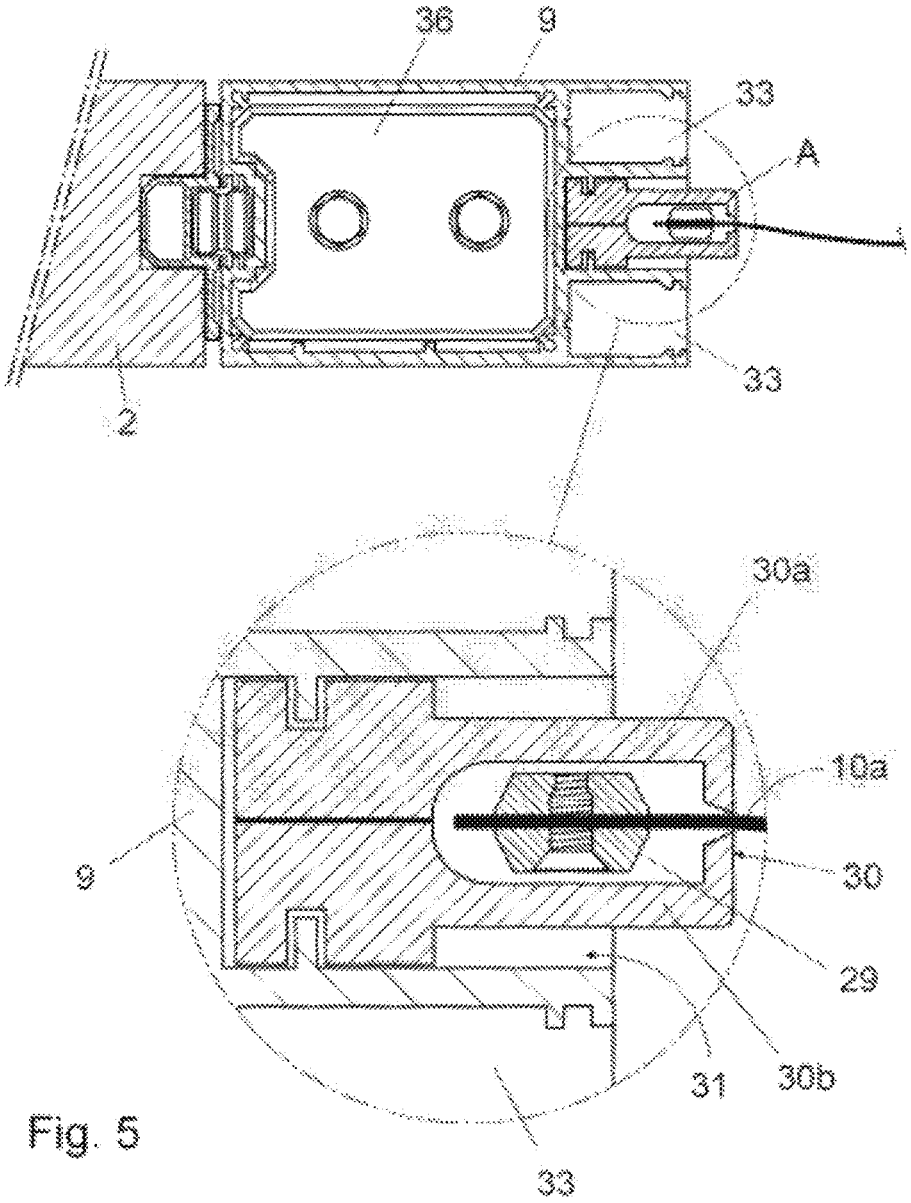
FIG. 5 shows an upper plan view of the elements of FIGS. 3 and 4 completely mounted and in which it is possible to see the mounting of one of the ends of the tarpaulin with respect to the corresponding vertical post of the door and a detailed enlargement of said area.

In FIG. 5, the closing tarpaulin (10) has on the lateral edges thereof a vertical row with stops (29) which are moveable through the inside of a guide (30) mounted on an intermediate notch (31) of the corresponding vertical post (9) of the door (6).

In FIG. 5, the stops (29) are made up of two halves arranged on opposite sides of the closing tarpaulin (10) and fixed to each other by a screw.

The guide (30) and the intermediate notch (31) can be seen with greater clarity in the exploded view in FIG. 3.

In the example in FIG. 1, the door comprises at least one photoelectric barrier with an emitter (34) and a light sensor (35) mounted on the vertical posts (9).

In FIGS. 1 and 6 the vertical posts (9) of the door comprise LED-type light signaling elements (42) with the function of a traffic light.

The vertical posts (9) define two end notchs (33) on sides of the intermediate notch (31), referenced in FIGS. 1 and 5, for the passage of cables and the mounting of different elements, such as the emitter (34) and the light sensor (35) of the photoelectric barrier or the previously mentioned light signaling elements (42).

The vertical posts (9) of the door frame are arranged on pieces (36) for support and lateral securing, fixed to the floor and shown in FIG. 5.

As can be seen in FIG. 7, the upper box (7) comprises fastening brackets (37) to the vertical posts (9) of the door frame by means of screws (39) referred to in FIGS. 1 and 7.

Said fastening brackets (37) support horizontal profiles (8*a*, 8*b*), the front cover (8*c*) and the frontal cover (22) of the upper box (7) and are provided with longitudinal grooves or cuts (38) for cables to run through the inside of the vertical post (9) of the door.

The fastening brackets (37) have guide means on the upper and lower areas thereof, represented by screws with washers—not shown—, on side covers (40) which close the assembly, and are fixed from the inside of the upper box (7) by means of a screw (41), visible in FIG. 6 and located at an intermediate point of the fastening bracket (37), making it impossible for said covers (40) to be able to move in the opening and closing cycles of the door (6).

As can be seen in FIG. 1, and in greater detail in FIG. 5, the closing tarpaulin (10) moves through the interior of a guide (30), formed by two symmetrical profiles (30*a* and 30*b*), which delimit a space for the circulation of the stops (29) of the tarpaulin (10).

Said guides (30) protrude from the respective vertical posts (9), allowing, in the case of an impact, the stops (29) to exit the guide (30), releasing the tarpaulin (10).

The symmetrical profiles (30*a*, 30*b*) of the guide (30) have an exit channel in an angular shape which minimizes the space that the closing tarpaulin (10) has to cross.

Figure 8A:
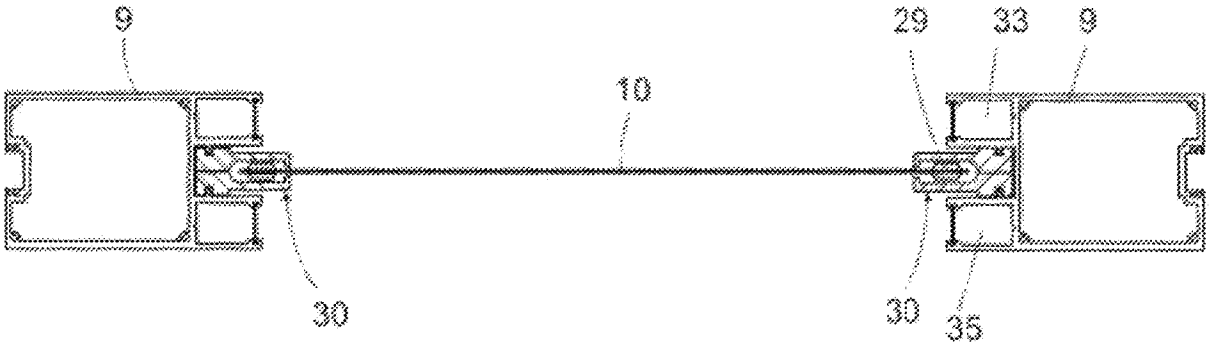
FIGS. 8*a* and 8*b* show two plan views of the door in cross section by a vertical plane, in which the closing tarpaulin is shown in two positions: without lateral pressure in FIG. 8*a*, and subjected to lateral pressure in FIG. 8*b*.

The tarpaulin (10) is sized such that when it is not subjected to any frontal thrust, as shown in FIG. 8*a*, the stops (29) are arranged in a loose form in the inside of the vertical guides (30) able to move longitudinally through the inside of the guides without any significant friction.

Figure 8B:
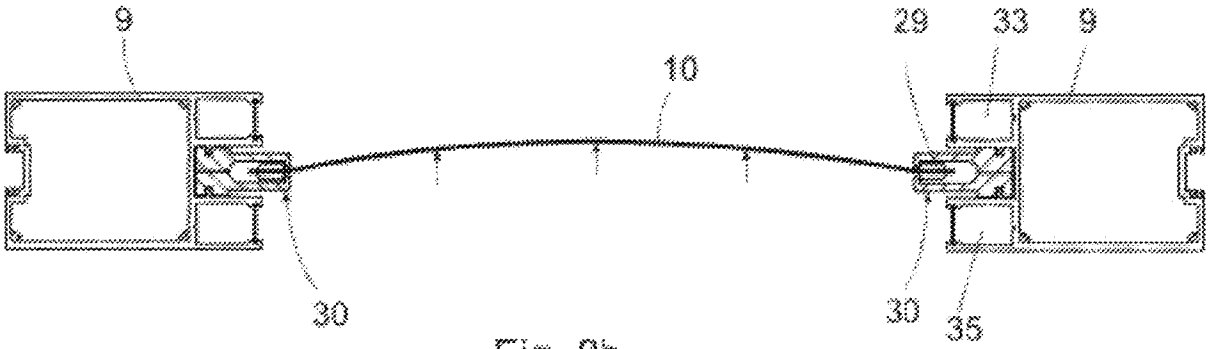

When the door is closed and the tarpaulin (10) is subjected to a frontal pressure or thrust, as shown in FIG. 8*b*, the stops (29) act against the inner surface of the guides (30) and the tarpaulin (10) becomes curved by the effect of the pressure, establishing a tight lateral closure against the aforementioned vertical guides (30), specifically against one of the symmetrical profiles (30*a*, 30*b*) as a function of the direction of the curve of the closing tarpaulin (10), minimizing the passage of air from one side of the door (6) to the other.

In the example shown in FIG. 6, the vertical posts (9) have at the top, below the upper box (7) and to the sides of the area of passage of the tarpaulin, recuperators (43) for returning the stops (29) to the inside of the longitudinal guides (30), during the upward movement of the tarpaulin (10), in the case that said stops (29) have been released from the longitudinal guides (30) as a result of a collision or frontal impact against the tarpaulin (10).

Having sufficiently described the nature of the invention, in addition to an example of preferred embodiment, it is hereby stated for the relevant purposes that the materials, shape, size and layout of the described elements may be modified, provided that it does not imply altering the essential characteristics of the invention claimed below.

The invention claimed is:

1. A modular enclosure, which comprises: a partition made up of panels provided with longitudinal grooves on the ends thereof for mounting coupling elements, said partition defining at least a space for mounting a door; and a door which is insertable in the partition, which comprises:

two vertical posts which delimit a passage space and have vertical guides for moving a closing tarpaulin and a closing tarpaulin fixed to a motorized winding drum; wherein:

the vertical posts of the frame comprise longitudinal channels facing the longitudinal grooves of the panels which delimit the mounting space of the door; said longitudinal grooves defining passages housing fastening elements vertically movable between: a position wherein the door is held with respect to the panels that delimit the mounting space; and a position wherein the door is released;

an upper box of the motorized winding drum make up an independent unit, fixed in a detachable way to the vertical posts of the door.

2. The enclosure, according to claim 1, wherein the fastening elements of the door are made up of a flexible strip, with attachments provided on opposite sides, said attachments being housed in the longitudinal channel of the corresponding vertical post of the door and in the longitudinal groove of the panel, or in a longitudinal groove of a second intermediate profile coupled to the aforementioned longitudinal groove of the corresponding panel.

3. The enclosure, according to claim 2, wherein the second profiles have on a face opposite to the longitudinal groove a longitudinal appendix which couples to the longitudinal groove of a panel adjacent to the door.

4. The enclosure, according to claim 1, wherein the upper box comprises a groove on the lower side thereof for the passage of the closing tarpaulin and said groove further comprising sealing gaskets on opposite sides thereof which act on the closing tarpaulin.

5. The enclosure, according to claim 4, wherein the upper box comprises: horizontal profiles, a frontal cover and a front cover, both removable; all of which are joined to fastening brackets of the upper box to the vertical posts of the door, the winding drum of the closing tarpaulin and an actuating motor mounted to said fastening brackets.

6. The enclosure, according to claim 4, wherein the closing tarpaulin has:— a first weight on the lower end thereof for vertical tension, in any complete or partial open position of the door;— a transversal bulge in an upper area thereof which in the closed position acts on the sealing gaskets, making a tight upper closure; and— vertical rows of stops on the lateral edges thereof which are movable from the inside of the vertical guide mounted on an intermediate notch of the corresponding vertical post of the door.

7. The enclosure, according to claim 6, wherein the winding drum has a transverse groove for housing the transversal bulge of the tarpaulin during the winding thereof.

8. The enclosure, according to claim 6, wherein the closing tarpaulin has on the lower end thereof, below the first weight, a second weight for the adjustment to the floor.

9. The enclosure, according to claim 1, wherein the door comprises at least one photoelectric barrier with a light emitter and a light sensor mounted on the vertical posts;

and/or in that the door comprise LED-type light signaling elements with the function of a traffic light mounted on the vertical posts.

10. The enclosure, according to claim 9, wherein the vertical posts further include two end notches (33) on the sides of the intermediate notch, for the passage of cables and the mounting of different elements, selected among the photoelectric barriers and light signaling elements.

11. The enclosure, according to claim 1, wherein the vertical posts of the door are supported and laterally secured on pieces fixed to the floor.

12. The enclosure, according to claim 1, wherein the fastening brackets for the upper box have a longitudinal groove for cables to run through the inside of the vertical profiles.

13. The enclosure, according to claim 6, wherein the vertical guide is made up of two symmetrical profiles, facing each other creating a space for the circulation of the tarpaulin with the stops; and said symmetrical profiles protrude from the vertical posts enabling the stops to exit the vertical guide in case of a frontal impact against the tarpaulin.

14. The enclosure, according to claim 12, wherein the space for the circulation of the tarpaulin created by said symmetrical profiles have an exit channel which minimizes the space for the circulation of the tarpaulin, said exit channel having an angular shape.

15. The enclosure, according to claim 5, wherein the upper box further comprises side covers, the fastening brackets having a guide to guide said side covers and fastening screws for said side covers.

16. The enclosure, according to claim 13, wherein the vertical posts have at the top part thereof, below the upper box, and at the sides of the exit passage, recuperators for returning the stops of the tarpaulin to the inside of the longitudinal guides, during the upward movement in the case that said stops have been released from the longitudinal guides.

* * * * *